US007268778B2

(12) United States Patent
Ushigusa

(10) Patent No.: US 7,268,778 B2
(45) Date of Patent: Sep. 11, 2007

(54) APPARATUS FOR DRIVING DISPLAY PANEL WITH EFFECTIVE DC-DC CONVERTERS

(75) Inventor: Yoshihiro Ushigusa, Sagamihara (JP)

(73) Assignee: Samsung SDI Co., Ltd., Suwon (KR)

( * ) Notice: Subject to any disclaimer, the term of this patent is extended or adjusted under 35 U.S.C. 154(b) by 673 days.

(21) Appl. No.: 10/834,251

(22) Filed: Apr. 29, 2004

(65) Prior Publication Data

US 2004/0217955 A1 Nov. 4, 2004

(30) Foreign Application Priority Data

May 1, 2003 (KR) ..... 10-2003-0027988

(51) Int. Cl.
*G09G 5/40* (2006.01)
*G09G 5/00* (2006.01)
*G09G 3/30* (2006.01)

(52) U.S. Cl. ..... 345/214; 345/76; 345/204; 345/211; 349/142; 349/143

(58) Field of Classification Search ..... 345/33, 345/76, 204, 211, 214; 349/68, 127, 128, 349/131, 139, 143, 142
See application file for complete search history.

(56) References Cited

U.S. PATENT DOCUMENTS 4,764,766 A * 8/1988 Aoyama et al. ..... 345/103
5,903,327 A * 5/1999 Hijii ..... 349/73
6,181,313 B1 * 1/2001 Yokota et al. ..... 345/100
6,236,443 B1 * 5/2001 Carlsen ..... 349/143
6,633,274 B1 * 10/2003 Yokota et al. ..... 345/100

* cited by examiner

*Primary Examiner*—Richard Hjerpe
*Assistant Examiner*—My-Chau T. Tran
(74) *Attorney, Agent, or Firm*—H.C. Park & Associates, PLC

(57) ABSTRACT

An apparatus for driving a display panel is provided. The display panel driving apparatus includes a main display controller, an icon display controller, a dot-matrix display controller, an icon driver, a dot-matrix driver, a first DC-DC converter, and a second DC-DC converter. The first DC-DC converter boosts an input DC voltage using a coil and supplies the boosted voltage as a first boost voltage to the dot-matrix driver. The second DC-DC converter boosts an input DC voltage using a capacitor and supplies the boosted voltage as a second boost voltage to the icon driver.

2 Claims, 2 Drawing Sheets

APPARATUS FOR DRIVING DISPLAY PANEL WITH EFFECTIVE DC-DC CONVERTERS

CROSS-REFERENCE TO RELATED APPLICATIONS

This application claims the priority of Korean Patent Application No. 2003-27988, filed on May 1, 2003, in the Korean Intellectual Property Office, the disclosure of which is incorporated herein by reference in its entirety.

1. Field of the Invention

The present invention relates to an apparatus for driving a display panel, for example, an electroluminescent display panel, and more particularly, to an apparatus for driving a display panel including an icon area on which icons predetermined according to icon data to be input are displayed and an dot-matrix area on which changeable images are displayed according to dot-matrix data to be input.

2. Description of the Related Art

Referring to FIG. 1, a conventional display panel 3, for example, an electroluminescent display panel 3 used in a cellular phone includes an icon area 31 and a dot-matrix area 32. As described in detail in U.S. Pat. No. 6,236,443, the icon area 31 has irregularly shaped display cells to display icons having a predetermined shape while the dot-matrix area 32 has regularly shaped display cells to display changeable images.

A conventional apparatus for driving such a display panel 3 comprises a display controller 1, an icon driver 21, a dot-matrix driver 22, and a DC-DC converter 4. The display controller 1 comprises a main display controller 11, an icon display controller 12, a dot-matrix display controller 13, an oscillator 14, and a memory 15. The display controller 1 operates by a direct-current voltage $V_{DD}$ that is slightly adjusted from a battery voltage $V_{BA}$.

The main display controller 11 divides input image data $D_{IM}$ into icon data $D_{IC}$ and dot-matrix data $D_{DM}$. The icon display controller 12 processes the icon data $D_{IC}$ received from the main display controller 11 to thereby output separate icon data $D_{ICD}$. The icon display controller 12 simultaneously outputs timing control signals $D_{ICC}$ according to the internal arrangement of the icon area 31 of the display panel 3. The dot-matrix display controller 13 processes the dot-matrix data $D_{DM}$ received from the main display controller 11 to thereby output separate dot-matrix data $D_{DMD}$. The dot-matrix display controller simultaneously outputs timing control signals $D_{DMC}$ according to the internal arrangement of the dot-matrix area 32 of the display panel 3. Here, the dot-matrix data $D_{DM}$, including the separate dot-matrix data $D_{DMD}$, received from the main display controller 11 is stored in the memory 15 by the dot-matrix display controller 13. The separate dot-matrix data $D_{DMD}$ stored in the memory 15 is read and output according to the timing control signals $D_{DMC}$ output from the dot-matrix display controller 13. The oscillator 14 generates a clock signal CLK1 consisting of pulses with a predetermined frequency, and supplies the clock signal CLK1 to the icon display controller 12 and the dot-matrix display controller 13.

The icon driver 21 generates icon driving signals $S_{IC}$ according to the icon data $D_{ICD}$ and the timing control signals $D_{ICC}$ received from the icon display controller 12, and drives the icon area 31 of the display panel 3 using the icon driving signals $S_{IC}$. The dot-matrix driver 22 generates dot-matrix driving signals $S_{DM}$ according to the dot-matrix data $D_{DMD}$ and the timing control signals $D_{DMC}$ received from the dot-matrix display controller 13, and drives the dot-matrix area 32 of the display panel 3 using the dot-matrix driving signals $S_{DM}$.

The DC-DC converter 4 boosts a battery voltage $V_{BA}$ as an input DC voltage using a coil and supplies the boosted voltage as a first boost voltage V1 to the dot-matrix driver 22 and the icon driver 21.

Here, the power of the icon driving signals $S_{IC}$ required by the icon driver 21 is much lower than the power of the dot-matrix driving signals $S_{DM}$ required by the dot-matrix driver 22. However, in the conventional driving apparatus, the first boost voltage V1 is supplied to both the dot-matrix driver 22 and the icon driver 21 by the DC-DC converter 4 using a coil boosting method suitable to a high driving power. This may cause a problem of an unnecessary increase in the power consumption of the icon driver 21. Such a problem may be more serious in appliances on which the icon area 31 is always displayed, such as, for example, a cellular phone, etc., and can cause inconvenience due to frequent charging of batteries.

SUMMARY OF THE INVENTION

The present invention provides an apparatus for driving a display panel including an icon area and a dot-matrix area, capable of maximizing the efficiency of a driving power, reducing power consumption of appliances, and improving a user's convenience.

According to an aspect of the present invention, there is provided an apparatus for driving a display panel. The display panel includes an icon area on which icons are displayed, where the icons are predetermined according to icon data to be input, and an dot-matrix area on which changeable images are displayed according to dot-matrix data to be input. The display panel driving apparatus comprises a main display controller, an icon display controller, a dot-matrix display controller, an icon driver, a dot-matrix driver, a first DC-DC converter, and a second DC-DC converter.

The main display controller divides input image data into the icon data and the dot-matrix data. The icon display controller processes the icon data received from the main display controller and simultaneously outputs separate icon data and timing control signals, according to an internal arrangement of the icon area of the display panel. The dot-matrix display controller processes the dot-matrix data received from the main display controller and simultaneously outputs separate dot-matrix data and timing control signals, according to an internal arrangement of the dot-matrix area of the display panel. The icon driver drives the icon area of the display panel according to the separate icon data and the timing control signals received from the icon display controller. The dot-matrix driver drives the dot-matrix area of the display panel according to the separate dot-matrix data and the timing control signals received from the dot-matrix display controller. The first DC-DC converter boosts an input DC voltage using a coil and supplies the boosted voltage as a first boost voltage to the dot-matrix driver. The second DC-DC converter boosts the input DC voltage using a capacitor and supplies the boosted voltage as a second boost voltage to the icon driver.

According to the display panel driving apparatus of the present invention, the first boost voltage V1 is supplied to the dot-matrix driver by the first DC-DC converter 41 using a coil boosting method suitable to a higher driving power, and the second boost voltage V2 is supplied to the icon driver by the second DC-DC converter using a capacitor boosting method suitable to a lower driving power. Accordingly, it is possible to maximize the efficiency of a driving power and reduce power consumption of appliances. This is because the power of icon driving signals $S_{DM}$ required by the icon driver is lower than the power of the dot-matrix driving signals $S_{DM}$ required by the dot-matrix driver. Such an effect according to the present invention is more significant in appliances on which an icon area is always displayed, such as, for example, a cellular phone, etc., and increases a user's convenience as it may reduce the charging frequency of the batteries.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
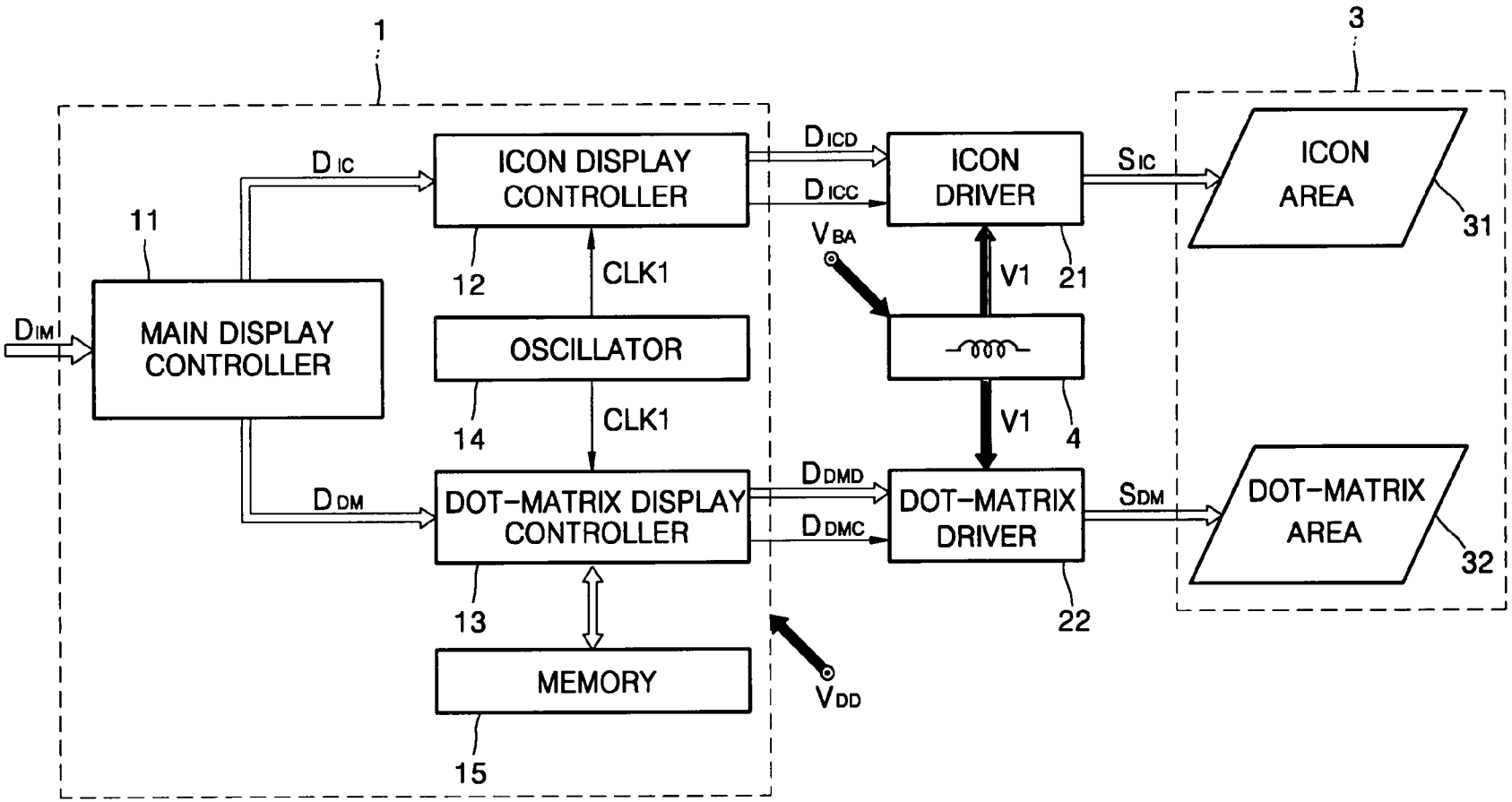
FIG. 1 (PRIOR ART)
FIG. 1 illustrates a conventional apparatus for driving a display panel.
Figure 2:
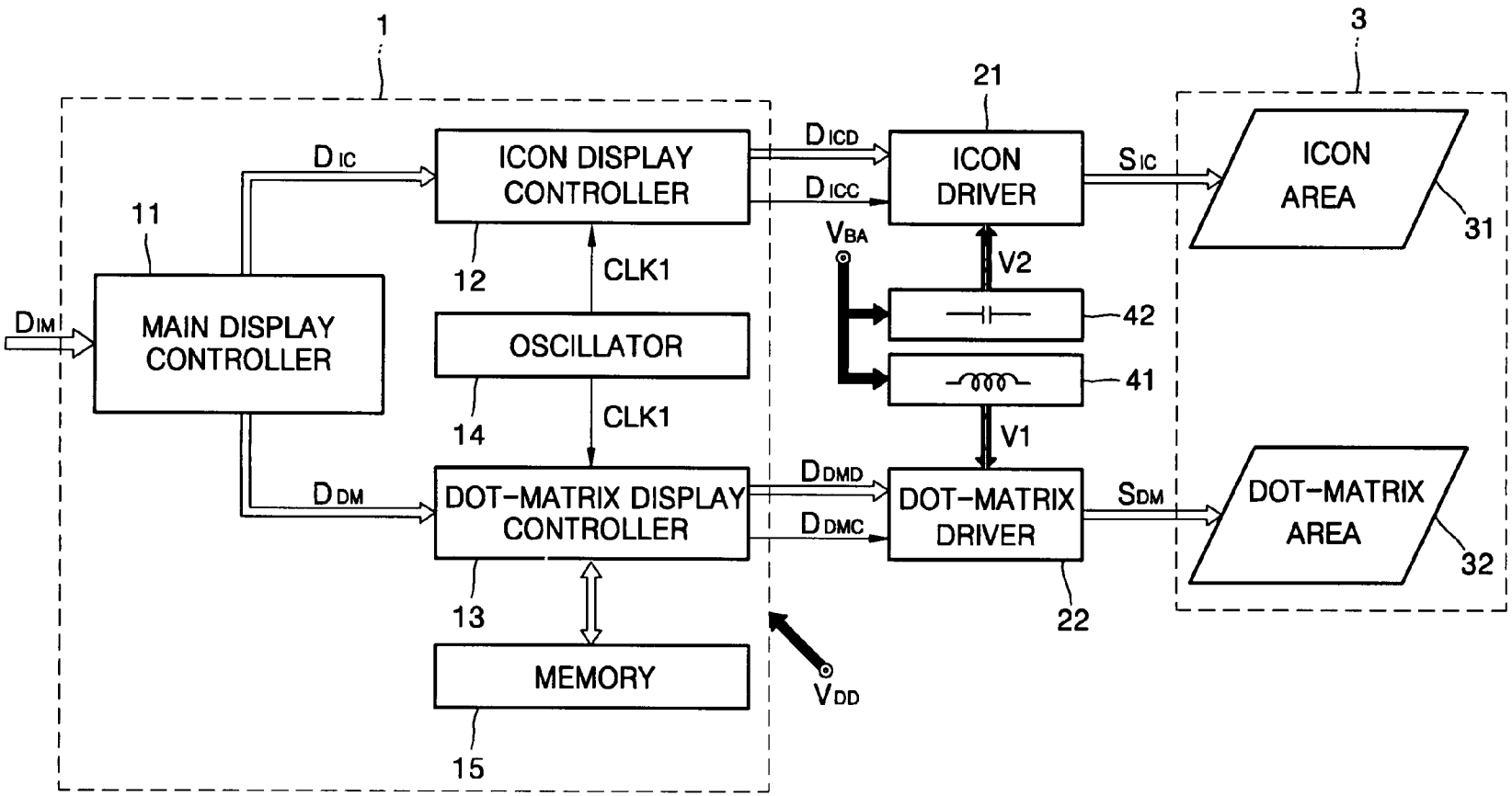
FIG. 2 illustrates an apparatus for driving a display panel, according to an embodiment of the present invention.

FIG. 2 illustrates an apparatus for driving a display panel, according to an embodiment of the present invention.

Referring to FIG. 2, a display panel 3, which is driven by a driving apparatus according to the present invention, for example, an electroluminescent display panel which is used in a cellular phone, etc., includes an icon area 31 and a dot-matrix area 32. The icon area 31 has irregularly shaped display cells for displaying icons having predetermined shapes, while the dot-matrix area 32 includes uniformly shaped display cells regularly arranged for displaying variable images.

An apparatus for driving such a display panel 3, according to an embodiment of the present invention, comprises a display controller 1, an icon driver 21, a dot-matrix driver 22, a first DC-DC converter 41, and a second DC-DC converter 42. The display controller 1 includes a main display controller 11, an icon display controller 12, a dot-matrix display controller 13, an oscillator 14, and a memory 15. The display controller 1 operates by a direct-current voltage $V_{DD}$ that is slightly adjusted from a battery voltage $V_{BA}$.

The main display controller 11 divides input image data $D_{IM}$ into icon data $D_{IC}$ and dot-matrix data $D_{DM}$. The icon display controller 12 processes the icon data $D_{IC}$ received from the main display controller 11 to thereby output icon data $D_{ICD}$. Simultaneously, icon display controller 12 outputs timing control signals $D_{ICC}$ according to the internal arrangement of the icon area 31 of the display panel 3. The dot-matrix display controller 13 processes the dot-matrix data $D_{DM}$ received from the main display controller 11 to thereby output separate dot-matrix data $D_{DMD}$, as well as simultaneously output timing control signals $D_{DMC}$, according to the internal arrangement of the dot-matrix area 32 of the display panel 3. Here, the dot-matrix data $D_{DM}$, including the separate dot-matrix data $D_{DMD}$, received from the main display controller 11 is stored in the memory 15 by the dot-matrix display controller 13. The separate dot-matrix data $D_{DMC}$ stored in the memory 15 is read and output according to the timing control signals $D_{DMC}$ output from the dot-matrix display controller 13. The oscillator 14 generates a clock signal CLK1 consisting of pulses with a predetermined frequency and supplies the clock signal CLK1 to the icon display controller 12 and the dot-matrix display controller 13.

The icon driver 21 generates icon driving signals $S_{IC}$, according to the icon data $D_{ICD}$ and the timing control signals $D_{ICC}$ received from the icon display controller 12, and drives the icon area 31 of the display panel 3 using the icon driving signals $S_{IC}$. The dot-matrix driver 22 generates dot-matrix driving signals $S_{DM}$, according to the dot-matrix data $D_{DMD}$ and the timing control signals $D_{DMC}$ received from the dot-matrix display controller 13, and drives the dot-matrix area 32 of the display panel 3 using the dot-matrix driving signals $S_{DM}$.

The first DC-DC converter 41 boosts a battery voltage $V_{BA}$ as an input DC voltage using a coil, and supplies the boosted voltage as a first boost voltage V1 to the dot-matrix driver 22. The second DC-DC converter 42 boosts the battery voltage $V_{BA}$ as an input DC voltage using a capacitor, and supplies the boosted voltage as a second boost voltage V2 to the icon driver 21. That is, the first boost voltage V1 is supplied to the dot-matrix driver 22 by the first DC-DC converter 41 using a coil boosting method suitable to a higher driving power. The second boost voltage V2 is supplied to the icon driver 21 by the second DC-DC converter 42 using a capacitor boosting method suitable to a lower driving power. Accordingly, it is possible to maximize the efficiency of a driving power and reduce power consumption of appliances. This is because the power of the icon driving signals $S_{DM}$ required by the icon driver 21 is lower than the power of the dot-matrix driving signals $S_{DM}$ required by the dot-matrix driver 22.

As described above, according to the display panel driving apparatus of the present invention, the first boost voltage V1 is supplied to the dot-matrix driver 22 by the first DC-DC converter 41 using a coil boosting method suitable to a higher driving power, and the second boost voltage V2 is supplied to the icon driver 21 by the second DC-DC converter 42 using a capacitor boosting method suitable to a lower driving power. Accordingly, it is possible to maximize the efficiency of a driving power and reduce power consumption of appliances. This is because a power of icon driving signals $S_{DM}$ required by the icon driver 21 is lower than a power of the dot-matrix driving signals $S_{DM}$ required by the dot-matrix driver 22. Such an effect according to the present invention may be more significant in appliances on which an icon area is always displayed, such as, for example, a cellular phone, etc., and increases a user's convenience as it may reduce the charging frequency of the batteries.

A structure of a display panel that may be used with the present invention is described in detail in U.S. Pat. No. 6,236,443, the contents of which are incorporated herein by reference in its entirety and therefore the detailed description thereof is omitted.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for driving a display panel, the display panel including an icon area on which icons are displayed, where predetermined icons are displayed according to input icon data, and an dot-matrix area on which changeable images are displayed according to input dot-matrix data, the apparatus comprising:

a main display controller, which divides input image data into the icon data and the dot-matrix data;

an icon display controller, which processes the icon data received from the main display controller and simultaneously outputs separate icon data and timing control signals, according to an internal arrangement of the icon area of the display panel;

a dot-matrix display controller, which processes the dot-matrix data received from the main display controller and simultaneously outputs separate dot-matrix data and timing control signals, according to an internal arrangement of the dot-matrix area of the display panel;

an icon driver, which drives the icon area of the display panel according to the separate icon data and the timing control signals received from the icon display controller;

a dot-matrix driver, which drives the dot-matrix area of the display panel according to the separate dot-matrix data and the timing control signals received from the dot-matrix display controller;

a first DC-DC converter, which boosts an input DC voltage using a coil and supplies the boosted voltage as a first boost voltage to the dot-matrix driver; and a second DC-DC converter, which boosts the input DC voltage using a capacitor and supplies the boosted voltage as a second boost voltage to the icon driver.

2. The apparatus of claim 1, further comprising a memory, wherein the dot-matrix data output from the main display controller is stored in the memory by the dot-matrix display controller, and the separate dot-matrix data stored in the memory is read and output by the dot-matrix display controller according to the timing control signals output from the dot-matrix display controller.

* * * * *